US005816002A

United States Patent [19]

Bifano et al.

[11] Patent Number: 5,816,002

[45] Date of Patent: Oct. 6, 1998

[54] EDGE STRIP

[75] Inventors: Gabriel F. Bifano, Miami; Erenio Reyes, Miramar, both of Fla.

[73] Assignee: Vinyl Corporation, Miami, Fla.

[21] Appl. No.: 967,153

[22] Filed: Nov. 10, 1997

[51] Int. Cl.[6] ..... E04F 13/06

[52] U.S. Cl. ..... 52/255; 52/85; 52/256; 52/257; 52/371; 52/364

[58] Field of Search ..... 52/85, 255, 256, 52/257, 364, 367, 371, 318, 86, 88, 287.1

[56] References Cited

U.S. PATENT DOCUMENTS

| | | |
|---|---|---|
| 830,792 | 9/1906 | Kuhne . |
| 1,748,284 | 2/1930 | Gersman . |
| 2,163,613 | 6/1939 | Manofsky . |
| 2,274,662 | 3/1942 | Briggs et al. . |
| 2,311,345 | 2/1943 | Mitchell . |
| 2,344,279 | 3/1944 | Beerthuis . |
| 2,745,277 | 5/1956 | Nelsson . |
| 3,008,273 | 11/1961 | Widin . |
| 3,201,908 | 8/1965 | Arnold . |
| 3,426,490 | 2/1969 | Taylor . |
| 4,324,079 | 4/1982 | Pearson . |
| 5,003,743 | 4/1991 | Bifano et al. . |
| 5,048,247 | 9/1991 | Weldy . |
| 5,060,438 | 10/1991 | O'Rourke . |
| 5,063,720 | 11/1991 | Bifano et al. . |
| 5,423,154 | 6/1995 | Maylon et al. . |
| 5,531,051 | 7/1996 | Chenier, Jr. et al. . |
| 5,699,638 | 12/1997 | Maylon ..... 52/86 |

OTHER PUBLICATIONS

Amico (Vinyl Drywall & Veneer Accessories pamphlet, pp. 2–12; no specified date.

*Primary Examiner*—Robert Canfield
*Attorney, Agent, or Firm*—Foley & Lardner

[57] ABSTRACT

An edge strip for being mounted along a base structure includes a first axially extending flange and a second axially extending flange obliquely extending from the first flange. The second flange includes a first support configured for being mounted adjacent to the base structure. The first support includes a head portion, a first neck portion between the head portion and the first flange, and a second neck portion spaced from the first neck portion between the head portion and the first flange.

25 Claims, 4 Drawing Sheets

EDGE STRIP

FIELD OF THE INVENTION

The present invention is directed to edge strips, such as plaster stops and corner beads used for forming smooth edges and surfaces along a base structure. In particular, the present invention is directed to an edge strip for providing a smooth and continuous arcuate edge or surface along the base structure.

BACKGROUND OF THE INVENTION

Edge strips, such as plaster stops and comer beads, are frequently used in the construction industry to form or assist in forming smooth, continuous edges or surfaces extending along base structures. Plaster stops are conventionally used to form a band of plaster, including stucco, various cements and various plastic materials, along a planar wall to accentuate or frame an architectural detail, such as a window, door or cove. Plaster stops typically include a first perforated flange which is nailed or plastered to the planar wall and a second perpendicularly extending imperforate flange, also known as a ground. The band is formed by mounting two spaced apart opposing plaster stops along the planar wall and filling the gap or channel between the plaster stops with the plaster material. The plaster stops provide a mold as well as a edge for the plaster material while the material dries. Once the plaster material dries, the outer surface of the plaster stops is painted or finished as desired.

Corner beads are typically used in the construction industry to reinforce corners and to assist in forming smooth, continuous corner edges. Corner beads typically include a pair of perpendicular perforated flanges coaxially extending along a coplanar bead. To form a corner edge, the pair of flanges are mounted along perpendicular surfaces of the base structure. A plaster material is then applied to the perpendicular surfaces of the base structure so as to cover the corner bead flanges and so as to form a smooth surface of plaster material extending along the bead.

It is frequently desirable to form an arcuate band along a planar wall or to form a smooth continuous corner edge about an accurately shaped door, window or other structure. To avoid the necessity of custom-shaped plaster stops and corner beads, plaster stops and corner beads are typically made of metal or plastic such that the plaster stops and corner beads can be selectively bent to form the desired arcuate shape. Unfortunately, bending the plaster stops and the corner beads creates large amounts of stress and strain in the flanges comprising the plaster stop and the corner beads. As a result, the resulting stress causes the bead or the perpendicular flange to undulate or bend in a non-uniform manner, thereby creating an undesirable rough or unevenly curved band or corner edge.

SUMMARY OF THE INVENTION

An edge strip for being mounted along a base structure includes a first axially extending flange and a second axially extending flange obliquely extending from the first flange. The second flange includes a first support configured for being mounted adjacent to the base structure. The first support includes a head portion, a first neck portion between the head portion and the first flange, and a second neck portion spaced from the first neck portion between the head portion and the first flange.

The present invention is more specifically directed to the aforementioned edge strip wherein the first neck portion has a first width and wherein the second neck portion has a second width substantially equal to the first width. The edge strip preferably includes a strut between the first and second neck portions having a width greater than the widths of the first and second neck portions. The strut preferably includes an aperture extending therethrough for mounting the first support to the base structure. In the embodiments illustrated, the edge strip includes a slot angularly extending inwardly and above the first neck portion to define the second neck portion. The slot preferably extends between an angle of about 30 degrees to an angle of about 60 degrees relative to the first flange.

The present invention is also more specifically directed to the aforementioned edge strip wherein the edge strip is formed from a deformable plastic. The head of the edge strip pinches towards the first neck portion during concave deformation of the edge strip. As a result, the edge strip provides a smooth and continuous arch with a concave shape along the base structure.

The present invention is also more specifically directed to a plaster stop for being mounted along a base structure. The plaster stop includes a first substantially imperforate flange having an axially extending rib and a second axially extending flange obliquely extending from the first flange. The second flange includes a first support configured for being mounted adjacent to the base structure. The first support includes a head portion, a first neck portion between the head portion and the first flange, and a second neck portion spaced from the first neck portion between the head portion and the first flange. The first flange preferably includes a reverse bend flange axially extending along an edge of the first flange.

The present invention is also more specifically directed to a corner bead for being mounted along a base structure. The corner bead includes a first axially extending perforated flange and a second axially extending flange obliquely extending from the first flange. The second flange includes a first support configured for being mounted adjacent to the base structure. The first support includes a head portion, a first neck portion between the head portion and the first flange and a second neck portion spaced from the first neck portion between the head portion and the first flange.

According to yet another aspect of the present invention, the first support of the edge strip includes a plurality of apertures extending through the first support which are sized for receiving fasteners to couple the first support to the base structure. Alternatively, or in addition, the first support includes a plurality of apertures extending through the first support which are sufficiently sized for receiving plaster flow to bond the first support to the base structure.

DETAILED DESCRIPTION OF THE PREFERRED EMBODIMENTS

Figure 1:
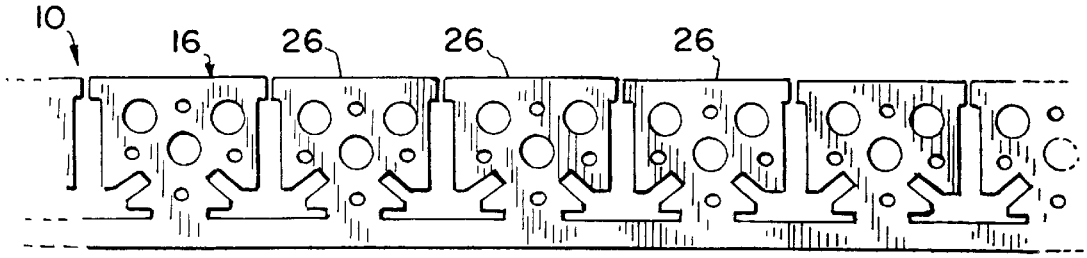
FIG. 1 is a fragmentary side elevational view of an exemplary edge strip of the present invention.
Figure 2:
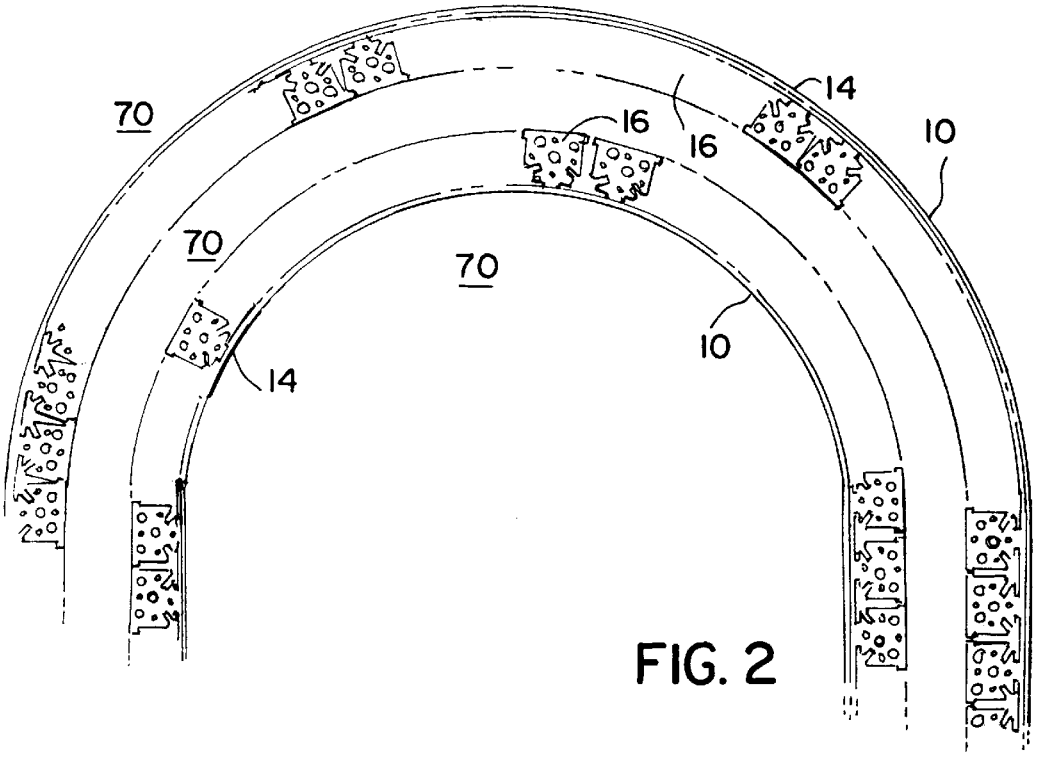
FIG. 2 is an enlarged side elevational view of the edge strip of FIG. 1.
Figure 3:
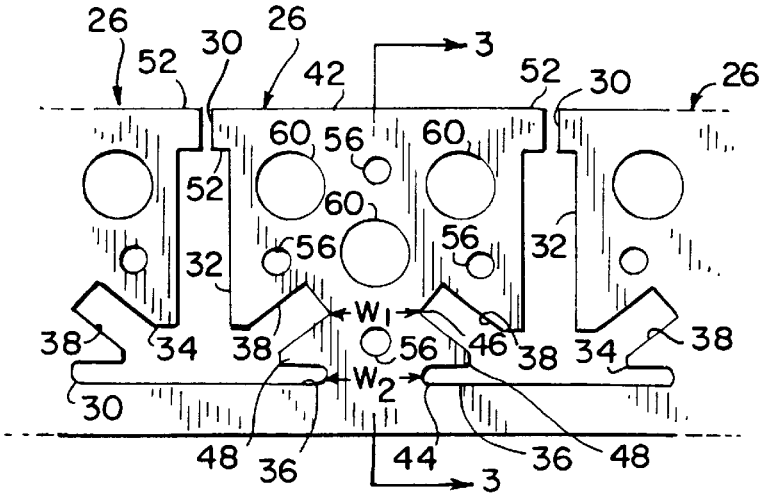
FIG. 3 is a sectional view of the edge strip taken along lines 3—3 of FIG. 2.

FIGS. 1–3 illustrate a portion of edge strip 10. FIG. 1 is a side elevational view of edge 10, while FIG. 2 is an enlarged side elevational view illustrating a smaller portion of edge strip 10. FIG. 3 is a cross-sectional view of edge strip 10 taken along lines 3—3. As best shown by FIG. 3, edge strip 10 comprises a plaster stop generally including axially extending flanges 14, 16. Flanges 14 and 16 obliquely extend from one another such that flange 16 may be secured along a base structure while flange 14 projects from the base structure. In the embodiment illustrated, flange 14 perpendicularly extends from flange 16 such that flange 14 also perpendicularly extends from the adjacent base structure. Flanges 14 and 16 are preferably made from a deformable and stretchable plastic such as polyvinylchloride (PVC).

Flange 14 obliquely extends from flange 16 and the adjacent base structure or wall to support and retain plaster materials, including but not limited to stucco, various cements and various plastic materials along the wall. Flange 14 includes an inner surface 18 and an outer surface 20. Inner surface 18 supports the plaster material while outer surface 20 provides a smooth outer surface for the band formed by edge strip 10. In the preferred embodiment illustrated, flange 14 additionally includes rib 22 and reverse bend flange 24. Rib 22 and reverse bend flange 24 project from inner surface 18 and assist in retaining plaster material along flange 14.

Flange 16 mounts edge strip 10 along the wall. As best shown by FIG. 1, flange 16 includes a plurality of supports 26 configured for being mounted adjacent the wall. As best shown by FIG. 2, each support 26 is separated from adjacent supports 26 by a kerf 30 which widens to form a slot 32 which further widens towards flange 14 to form opening 34. Slot 32 preferably has a width of about 5/16ths of an inch while opening 34 preferably has a width of about 15/16ths of an inch.

To facilitate the arcuate bending of edge strip 10, each support 26 additionally includes slots 36 and 38. Slots 36 are generally cut outs or openings extending from opening 34 into each support 26 on opposite sides of each support 26. In the embodiment illustrated, each slot 36 extends into each support 26 by a distance of about 5/16ths of an inch. Slots 36 axially extend along edge strip 10 parallel to flange 14. As a result, kerf 30, slot 32, opening 34 and slots 36, between adjacent supports 26 have an overall inverted T-shape.

Slots 38 angularly extend from opening 34 away from flange 14, above slots 36. Slots 38 preferably extend at an angle of between approximately 30 to approximately 60 degrees relative to flange 14. In the preferred embodiment illustrated, slots 38 extend at an angle of about 45 degrees relative to first flange 14. Slots 38 preferably extend inwardly into each support 26 so as to terminate approximately directly above the end of slot 36. In the embodiment illustrated, each slot 38 extends inwardly into each support by a distance of about 7/16ths of an inch.

As a result of kerf 30, slot 32, opening 34, slots 36 and slots 38, each support 26 has a well defined configuration including head portion 42, neck portion 44, neck portion 46 and struts 48. Each head portion 42 provides a majority of the surface area of each support 26 for securing support 26 to the adjacent wall. Each head portion 42 includes a pair of opposing ears 52 spaced from an adjacent ear 52 of an adjacent support 26 by kerf 30. In the embodiment illustrated, kerf 30 spaces adjacent ears 52 from one another by a distance of about 1/16ths of an inch prior to arcuate bending of edge strip 10. Because ears 52 of adjacent supports 26 are spaced from one another by kerf 30, head portions 42 more easily overlap one another and are less likely to abut one another during the arcuate deformation of edge strip 10. Each head portion 42 is supported relative to flange 14 by neck portions 44, 46 and struts 48.

Neck portion 44 is defined by opposing slots 36 and extends upward from flange 14 towards struts 48 and head portion 44. Neck portion 46 is defined by opposing slots 38 and extends above neck portion 44 between struts 48 and head portion 42. Neck portion 46 preferably has a width W1 essentially equal to width W2 of neck portion 44. In the preferred embodiment illustrated, each neck portion 44, 46 preferably has a width W1, W2, respectively, of about 9/16ths of an inch.

Struts 48 are located between neck portions 44 and 46 and axially extend outward from necks portions 44 and 46 to provide support and strength to the portion of support 26 extending between head portion 42 and flange 14. As further discussed below, it has been discovered that the above-described configuration and material of supports 26 provide the strongest mounting of flange 14 to an adjacent base structure while also enabling edge strip 10 to be arcuately bent with flange 16 on a concave side without undesirable undulation. Consequently, edge strip 10 forms a smooth arcuate outer surface 20 along flange 14.

As further shown by FIG. 2, each support 26 includes a plurality of apertures 56, 58 and 60. Apertures 56 extend through head portion 42 and are preferably equidistantly spaced about apertures 60. Apertures 56 are preferably sized for receiving fasteners such as nails or screws for mounting head portion 42 along a base structure such as a wall. Aperture 58 extends through support 26 between neck portions 44 and 46 and between struts 48 to mount struts 48 and a lower portion of support 26 along the base structure or wall. Aperture 58 is preferably sized for receiving a fastener such as a nail or screw. Apertures 60 extend through head portion 42 of support 26 and are preferably equidistantly spaced about apertures 56. Apertures 60 are preferably sufficiently sized for receiving sufficient plaster flow therethrough such that the plaster material covering supports 26 bonds flange 16 to the base structure or wall. In the preferred embodiment illustrated, apertures 60 have a diameter of approximately 7/16ths of an inch.

Figure 4:
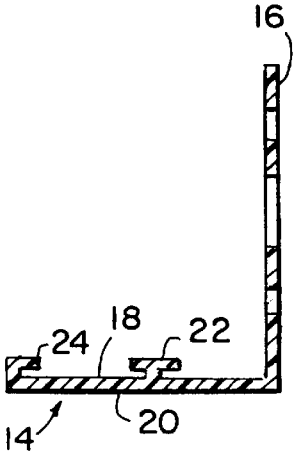
FIG. 4 is a side elevational view of a pair of the edge strips of FIG. 1 mounted along a base structure in opposition to one another.
Figure 5:
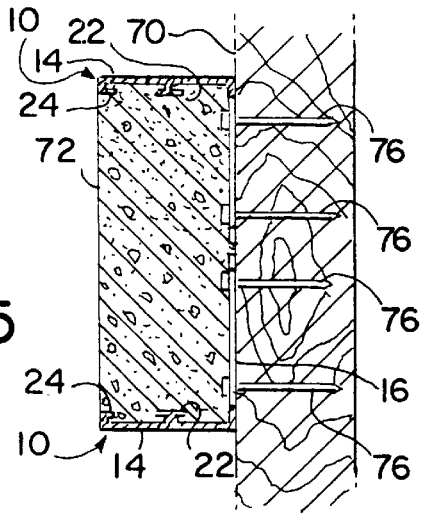
FIG. 5 is a sectional view of the edge strips of FIG. 4 having plaster material filled therebetween.

FIGS. 4 and 5 illustrate a pair of opposing edge strips 10 mounted along an adjacent wall 70 to form an arcuately shaped mold for being filled with plaster material to form a plaster band 72 (shown in FIG. 5). As shown by FIG. 4, forming plaster band 72 generally requires two edge strips 10 positioned opposite one another with flanges 14 defining the outer most sides of the band and with flanges 16 positioned between both flanges 14 along wall 70. Each edge strip 10 is arcuately bent to provide the preferred arcuate shape of band 72. As a result, flanges 16 of the inner most edge strip 10 extend along a convex side while flanges 16 of the outermost edge strip 10 extend along a concave side of their respective edge strips 10. As shown by FIG. 5, flanges 16 are mounted to wall 70 with fasteners 76 which extend apertures 56. Plaster material is then filled in between edge strips 10 and allowed to dry to form band 72. Plaster material also flows through apertures 60 (shown in FIG. 2) to provide additional bonding of band 72 and edge strip 10 to wall 70. Due to the configuration of supports 26 forming flange 16, flange 14, forming the outermost edge of band 72 has a smooth continuous arcuate surface.

Figure 6:
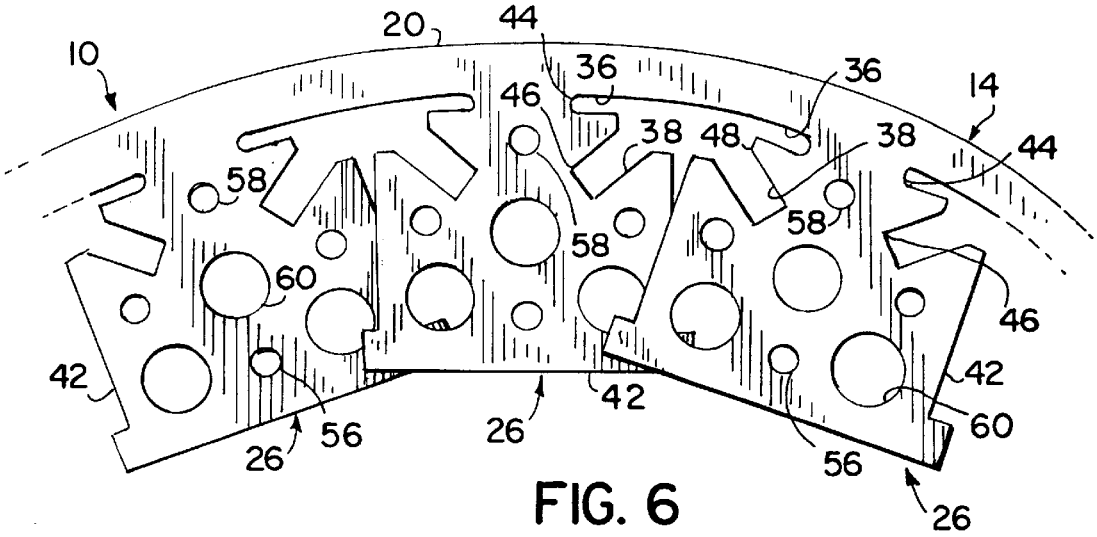
FIG. 6 is an enlarged fragmentary side elevational view of the edge strip of FIG. 1 arcuately bent.
Figure 7:
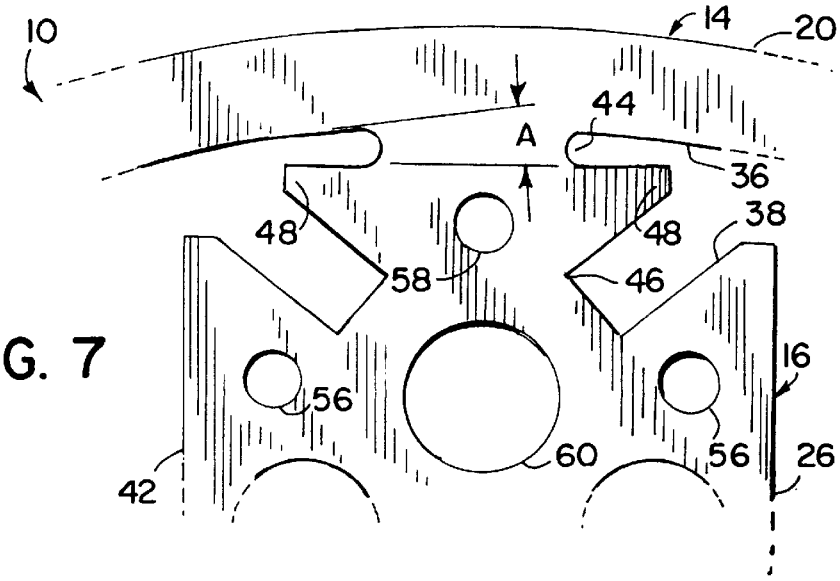
FIG. 7 is a greatly enlarged side elevational view of the edge strip of FIG. 1 arcuately bent.

FIG. 6 and 7 are enlarged fragmentary side elevational views illustrating a single edge strip 10 arcuately deformed with flange 16 extending along a concave side of the edge strip 10. As shown by FIG. 6, during arcuate bending of edge strip 10, head portions 42 of supports 26 overlap one another and pinch towards neck portion 44. Neck portions 44 and 46 pivot between flange 14 and head portion 42. At the same time, slots 36 and 38 relieve stress within support 26 while providing an adequate amount of surface area and strength to mount edge strip 10 to the wall and to prevent support 26 from cracking or breaking. As shown by FIG. 7, flange 14 pivots at an angle A about neck portions 44 and 46 of head 42 to provide a relatively smooth, continuous arcuate outer surface 20 for the band being formed.

Figure 9:
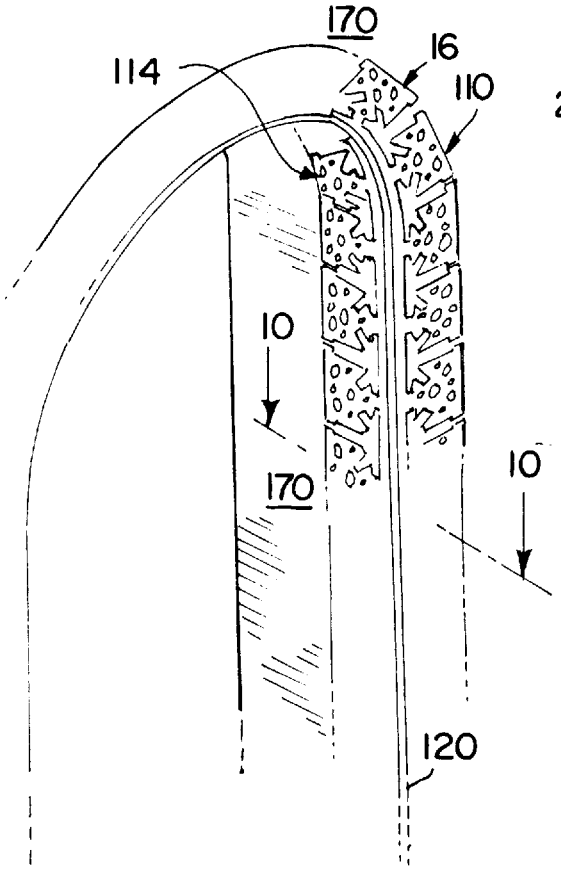
FIG. 9 is a perspective view of the edge strip of FIG. 8 mounted along an arcuate corner of a base structure.
Figure 8:
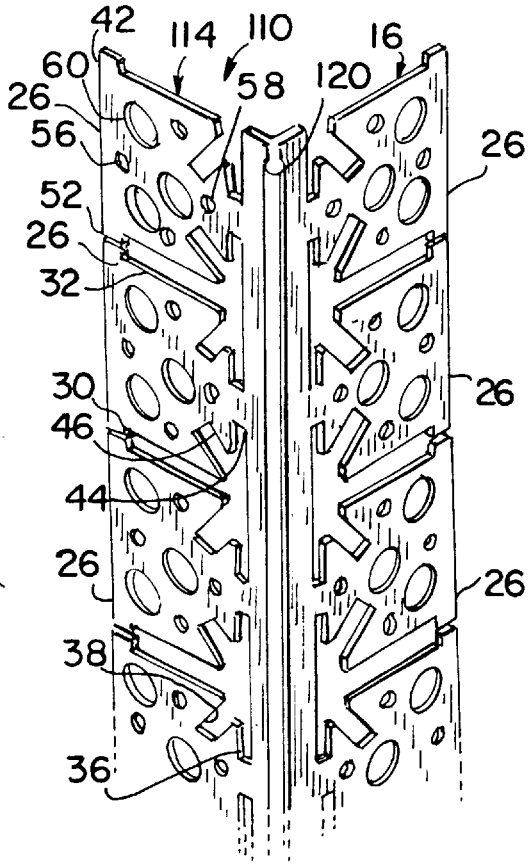
FIG. 8 is a perspective view of a second embodiment of the edge strip of FIGS. 1–7.
Figure 10:
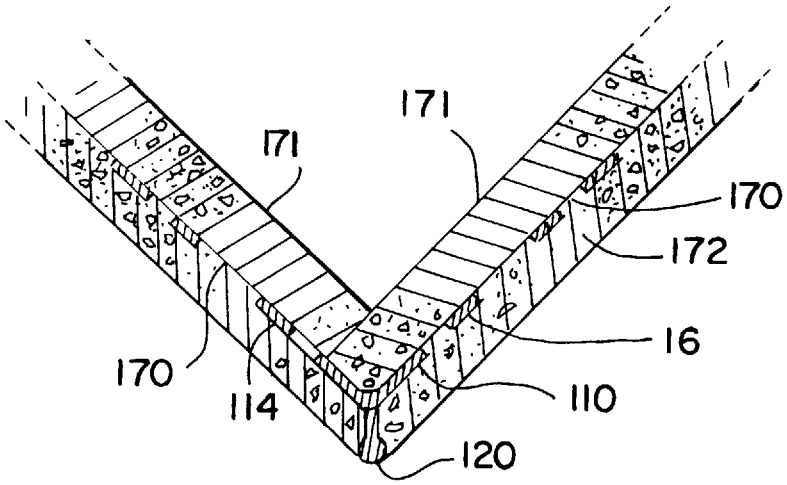
FIG. 10 is a sectional view of the edge strip of FIG. 9 with plaster material applied thereto.

FIGS. 8–10 illustrate edge strip 110, a second embodiment of edge strip 10 shown in FIGS. 1–7. Edge strip 110 is similar to edge strip 10 except that edge strip 110 includes flange 114 in lieu of flange 14 and additionally includes bead 120. For ease of discussion, those remaining elements of edge strip 110 which are similar to corresponding elements of edge strip 10 are numbered similarly.

In contrast to flange 14, flange 114 is configured for being mounted along and adjacent to a base structure such as a wall. Accordingly, flange 114 is preferably perforated to facilitate the mounting of flange 114 adjacent to the wall. In the preferred embodiment illustrated, flange 114 is substantially identical to flange 16.

Bead 120 defines an outer corner surface against which plaster may be applied. Bead 120 coaxially extends along edge strip 110 and projects away from the corner formed at the juncture of flanges 16 and 114. In the preferred embodiment illustrated, bead 120 provides a round surface against which plaster 172 (shown in FIG. 10) may be applied to form a smooth rounded corner or edge. Alternatively, bead 120 may be pointed for forming a smooth, sharp corner or edge.

As shown by FIG. 9, edge strip 10 functions as a corner bead with flanges 16 and 114 extending parallel and adjacent to obliquely extending surfaces 170 of a base structure 171 such that bead 120 axially extends along a corner intersecting the oblique surfaces 170 of the base structure 171. Flange 16 bends along a convex side of bead 120 while flange 114 bends along a concave side of bead 120. Each support 26 of flange 114 deforms as shown in FIG. 7. Because both flanges 16 and 114 include the above described spaced supports 26, edge strip 110 may be arcuately bent or deformed to mate with the arcuately shaped corner of the base structure without causing bead 120 to undulate. As a result, once plaster material 172 is applied over flanges 16 and 114 up to bead 120, as shown by FIG. 10, creates a smooth, continuous arcuate corner edge.

Figure 12:
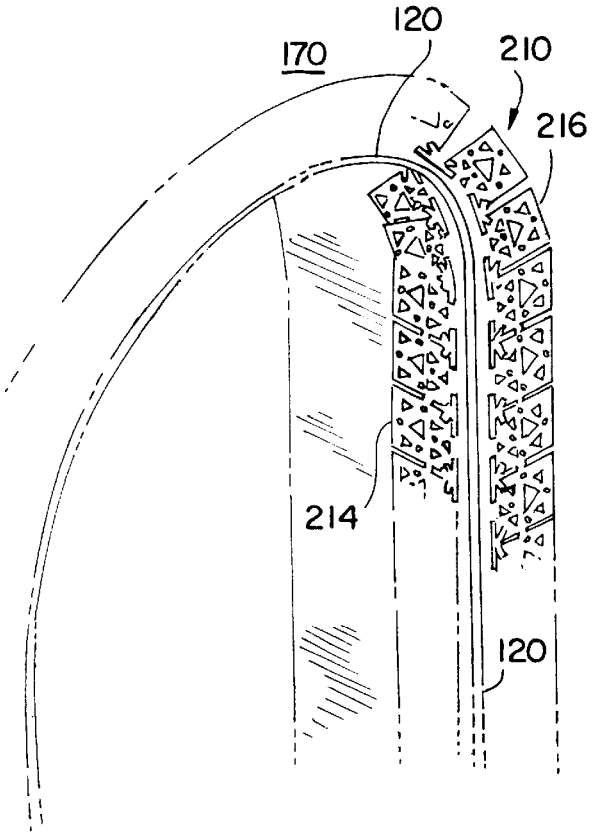
FIG. 12 is a perspective view of the edge strip of FIG. 11 mounted along an arcuate corner of a base structure.
Figure 11:
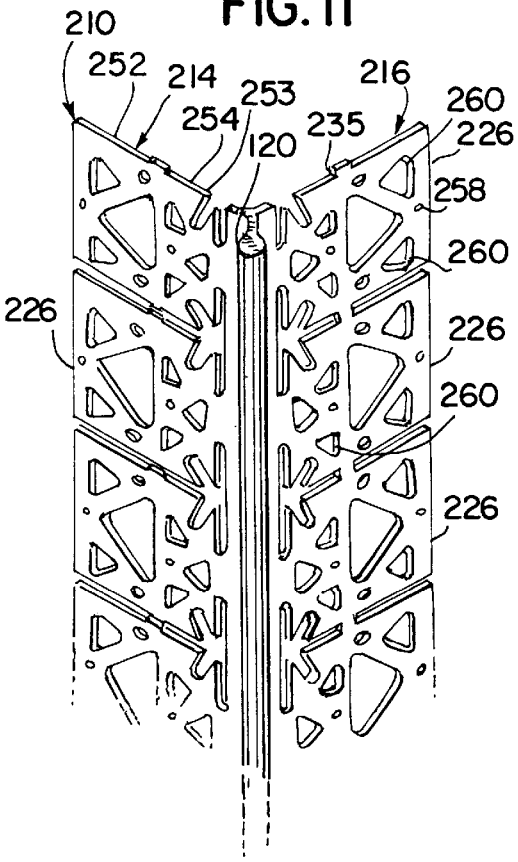
FIG. 11 is a perspective view of a third embodiment of the edge strip of FIGS. 1–7.
Figure 13:
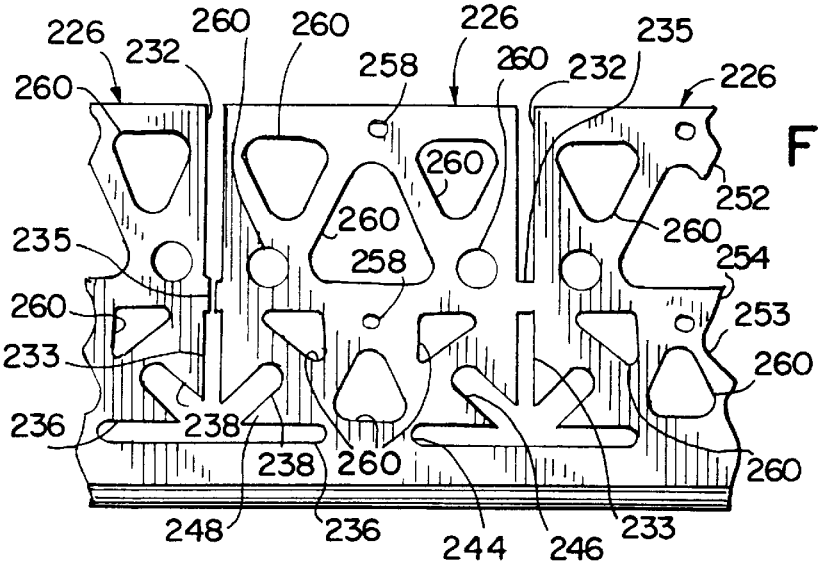
FIG. 13 is an enlarged fragmentary side elevational view of the edge strip of FIGS. 11 and 12.

FIGS. 11–13 illustrate edge strip 110, a third embodiment of edge strip 10 shown in FIGS. 1–7. Edge strip 210 is similar to edge strip 110 except that edge strip 210 includes flanges 214 and 216 in lieu of flanges 114 and 116, respectively. Flanges 214 and 216 are substantially identical to one another and preferably extend from bead 120 perpendicular to one another. Flanges 214 and 216 each include a plurality of supports 226 configured for being mounted adjacent the wall. Each support 226 is separated from adjacent supports 226 by upper slot 232 and lower slot 233. Adjacent supports 226 are attached to one another by a bridge 235 spanning adjacent supports 226 between slots 232 and 233. Slots 232 and 233 preferably have a width of about 3/16th of an inch.

To facilitate the arcuate bending of edge strip 210, each support additionally includes slots 236 and 238. Slots 236 and 238 are substantially identical to slots 36 and 38 shown in FIGS. 1–10. Similar to slots 36, slots 236 are generally cut outs or openings extending from lower slot 233 into each support 226 parallel to bead 120. As a result, slots 232, 233 and 236 have an overall inverted T-shape.

Slots 238 angularly extend from the junction of slot 236 and slots 232 away from bead 120 above slots 236. Slots 238 preferably extend at an angle of between approximately 30 to approximately 60 degrees relative to bead 120. In the preferred embodiment illustrated, slots 238 extend at an angle of about 45 degrees relative to bead 120. Slots 238 preferably extend inwardly into each support 226 so as to terminate proximate to the end of slot 236.

As a result of slots 232, 233, 236 and 238, each support 226 has a well-defined configuration including head portion 242, neck portion 244, neck portion 246 and struts 248. Each head portion 242 provides a majority of the surface area of each support 226 for securing support 226 to the adjacent wall. Each head portion 242 includes an upper portion 252, a lower portion 253 and an intermediate portion 254. Upper portion 252 and lower portion 253 each include a plurality of apertures 258 and 260. Apertures 258 extend through upper portion 252 and lower portion 253 and are preferably sized for receiving fasteners such as nails or screws for mounting head portion 242 along a base structure such as a wall. Apertures 260 extend through upper portions 252 and 253 and are sufficiently sized for receiving sufficient plaster flow therethrough such that the plaster material covering supports 226 bonds flange 216 to the base structure or wall.

Intermediate portion 254 is an elongate strip of solid material extending between upper portion 252 and lower portion 253 along flanges 214 and 216. Intermediate portion 254 connects upper portion 252 and lower 253. Intermediate portion 254 also provides a solid boundary between upper portion 252 and lower portion 253 such that flanges 214 and 216 may be cut along intermediate portion 254 to sever upper portion 252 from flanges 214 and 216 to reduce the height of flanges 214 and 216 as desired.

As best shown by FIGS. 12 and 13, bridges 235 spanning adjacent supports 226 may be cut to separate adjacent supports 226 so as to enable adjacent supports 226 to pivot relative to one another when positioned along an arcuate or curving portion of a support structure or wall. When positioned along straight or linear portions of a support structural wall, bridges 235 are preferably left intact so as to rigidly secure adjacent supports 226 to one another for providing additional strength and support to the support structure or wall.

Neck portions 244 and struts 248 of supports 226 are substantially identical to neck portions 44 and struts 48 of edge strips 10 and 110. As with edge strips 10 and 110, is has been discovered that the above-described configuration and material of supports 226 provide the strongest mounting of flanges 214 and 216 to an adjacent base structure while also enabling edge strip 210 to be arcuately bent while avoiding undesirable undulation. Consequently, edge strip 210 forms a smooth arcuate bead 120 along the support structure.

Although the present invention has been described with reference to preferred embodiments, workers skilled in the art will recognize that changes may be made in form and detail without departing from the spirit and scope of the invention.

What is claimed is:

1. An edge strip for being mounted along a base structure, the edge strip comprising:

a first axially extending flange;

a second axially extending flange obliquely extending from the first flange, the second flange including a first support configured for being mounted adjacent to the base structure, the first support including:

a head portion;

a first neck portion between the head portion and the first flange;

a second neck portion spaced from the first neck portion between the head portion and the first flange; and a strut between the first and second neck portions, the strut having a width greater than the widths of the first and second neck portions.

2. The edge strip of claim 1, wherein the first flange is imperforate.

3. The edge strip of claim 2, wherein the first flange includes a reverse bend flange axially extending along an edge of the first flange.

4. The edge strip of claim 2, wherein the first flange includes an axially extending rib.

5. The edge strip of claim 1, wherein the first flange is perforate.

6. The edge strip of claim 5, wherein the first flange includes a plurality of apertures extending through the first flange which are sized for receiving fasteners to couple the first flange to the base structure.

7. The edge strip of claim 5, wherein the first flange includes a plurality of apertures extending through the first flange which are sufficiently sized for receiving plaster flow to bond the first flange to the base structure.

8. The edge strip of claim 5, wherein the first flange includes:

a first plurality of apertures extending through the first flange which are sized for receiving fasteners to couple the first flange to the base structure; and a second plurality of apertures extending through the first flange which are sufficiently sized for receiving plaster flow to bond the second flange to the base structure.

9. The edge strip of claim 1, wherein the first flange includes a plurality of axially spaced supports.

10. The edge strip of claim 9, wherein each of the plurality of supports includes:

a head portion;

a first neck portion between the head portion and the second flange; and a second neck portion spaced from the first neck portion between the head portion and the second flange.

11. The edge strip of claim 1, wherein the first support includes the plurality of apertures extending through the first support which are sized for receiving fasteners to couple the first support to the base structure.

12. The edge strip of claim 1, wherein the first support includes the plurality of apertures extending through the first support which are sufficiently sized for receiving plaster flow to bond the first support to the base structure.

13. The edge strip of claim 1, wherein the first support includes:

a first plurality of apertures extending through the first support which are sized to receive the fasteners to couple the first support to the base structure; and a second plurality of apertures extending through the first support which are sufficiently sized for receiving plaster flow to bond the first support to the base structure.

14. The edge strip of claim 1, wherein the edge strip is made from a deformable plastic.

15. The edge strip of claim 1, wherein the first neck portion has a first width and wherein the second neck portion has a second width substantially equal to the first width.

16. The edge strip of claim 1, including an aperture extending through the strut for mounting the first support to the base structure.

17. The edge strip of claim 1, wherein the first support includes a slot angularly extending inwardly and above the first neck portion, the slot defining the second neck portion.

18. The edge strip of claim 17, wherein the slot extends at an angle of between approximately 30 to 60 degrees relative to the first flange.

19. The edge strip of claim 1, wherein the head portion pinches towards the first neck portion during concave deformation of the edge strip.

20. The edge strip of claim 1, wherein the second flange includes a second support axially spaced from the first support.

21. The edge strip of claim 20, wherein the second support includes:

a head portion;

a first neck portion between the head portion and the first flange; and a second neck portion spaced from the first neck portion between the head portion and the first flange.

22. An edge strip for being mounted along a base structure, the edge strip comprising:

a first axially extending flange;

a second axially extending flange obliquely extending from the first flange, the second flange including a first support configured for being mounted adjacent to the base structure, the first support including:

a head portion;

a first neck portion between the head portion and the first flange; and a slot extending from an edge of the first support, the slot angularly extending inwardly and above the first neck portion.

23. The edge strip of claim 22, wherein the slot extends at an angle of between approximately 30 to 60 degrees relative to the first flange.

24. A plaster stop for being mounted along a base structure, the plaster stop comprising:

a first substantially imperforate, axially extending flange formed from a deformable plastic; and a second axially extending flange obliquely extending from the first flange, the second flange including a first support configured for being mounted adjacent to the base structure, the first support including:

a head portion;

a first neck portion between the head portion and the first flange;

a second neck portion spaced from the first neck portion between the head portion and the first flange;

and a strut between the first and second neck portions, the strut having a width greater than the widths of the first and second neck portions.

25. A corner bead for being mounted along the base structure, the corner bead comprising:

a first axially extending flange, the first axially extending flange including a first support configured for being mounted adjacent to the base structure, the first support including:

a head portion;

a first neck portion adjacent the head portion;

a second neck portion spaced from the first neck portion; and a strut between the first and second neck portions, the strut having a width greater than the widths of the first and second neck portions; and a second axially extending flange obliquely extending from the first flange, the second flange including a support configured for being mounted adjacent to the base structure, the second support including:

a head portion;

a first neck portion; and a second neck portion spaced from the first neck portion.

* * * * *